US007472691B2

(12) United States Patent
Nagatomo et al.

(10) Patent No.: US 7,472,691 B2
(45) Date of Patent: Jan. 6, 2009

(54) FUEL INJECTION VALVE

(75) Inventors: Hiroaki Nagatomo, Tsushima (JP); Kimitaka Saito, Nagoya (JP); Masatoshi Kuroyanagi, Kariya (JP)

(73) Assignee: Denso Corporation (JP)

( * ) Notice: Subject to any disclaimer, the term of this patent is extended or adjusted under 35 U.S.C. 154(b) by 49 days.

(21) Appl. No.: 11/714,805

(22) Filed: Mar. 7, 2007

(65) Prior Publication Data

US 2007/0164134 A1 Jul. 19, 2007

Related U.S. Application Data

(63) Continuation of application No. 11/453,050, filed on Jun. 15, 2006, now Pat. No. 7,216,632.

(30) Foreign Application Priority Data

Jun. 15, 2005 (JP) ..... 2005-175742

(51) Int. Cl.
*F02M 59/46* (2006.01)
*F02M 59/48* (2006.01)

(52) U.S. Cl. ..... 123/467; 239/533.12

(58) Field of Classification Search ..... 123/500, 123/501, 467, 446, 299, 300, 468–470; 239/95–98, 239/533.12, 533.2, 533.3, 533.4
See application file for complete search history.

(56) References Cited

U.S. PATENT DOCUMENTS

| | | | |
|---|---|---|---|
| 4,856,713 | A | 8/1989 | Burnett |
| 4,909,444 | A | 3/1990 | Sczomak |
| 4,958,605 | A | 9/1990 | O'Neal et al. |
| 6,425,368 | B1 | 7/2002 | Lambert |
| 6,543,408 | B1 | 4/2003 | Ernst et al. |
| 6,561,436 | B1 | 5/2003 | Boecking |
| 6,575,132 | B1 | 6/2003 | Ernst et al. |
| 6,691,935 | B1 | 2/2004 | Potz et al. |
| 6,732,949 | B1 | 5/2004 | Harn Dorf |
| 6,748,917 | B1 | 6/2004 | Hoffmann et al. |
| 6,871,800 | B2 | 3/2005 | Tinwell et al. |

(Continued)

FOREIGN PATENT DOCUMENTS

EP 0470348 A1 6/1991

(Continued)

OTHER PUBLICATIONS

EPO Search/Examination Report dated Sep. 6, 2006.

*Primary Examiner*—Mahmoud Gimie
(74) *Attorney, Agent, or Firm*—Nixon & Vanderhye PC

(57) ABSTRACT

A valve body surrounds a first passage connecting with a cylinder of an engine. A valve member is adapted to be seated on and lifted from the valve seat. An injector body connects with the valve body. The injector body has a pressure control chamber for controlling hydraulic pressure applied to the valve member thereby controlling a lift of the valve member. The injector body has a second passage through which fuel in the pressure control chamber is exhausted. An actuator is adapted to communicating the pressure control chamber with the first passage through the second passage and blocking the pressure control chamber from the first passage. The first passage introduces fuel from the pressure control chamber into the cylinder through the second passage.

3 Claims, 10 Drawing Sheets

U.S. PATENT DOCUMENTS

2003/0010845 A1 1/2003 Carroll, III et al.
2003/0234006 A1 12/2003 Saito et al.
2004/0195385 A1 10/2004 Lawrence et al.
2005/0098144 A1 5/2005 Stewart et al.

FOREIGN PATENT DOCUMENTS

JP 4-12165 1/1992

FUEL INJECTION VALVE

CROSS REFERENCE TO RELATED APPLICATIONS

This application is a continuation of U.S. application Ser. No. 11/453,050, filed Jun. 15, 2006, now U.S. Pat. No. 7,216,632, issued May 15, 2007, and is based on and incorporates herein by reference Japanese Patent Application No. 2005-17542 filed on Jun. 15, 2005.

FIELD OF THE INVENTION

The present invention relates to a fuel injection valve.

BACKGROUND OF THE INVENTION

For example, a fuel injection system includes a fuel injection valve provided to a direct injection gasoline engine for jetting fuel directly into a combustion chamber of the engine. In general, a direct injection engine has a structure, in which stratified combustion is formed to improve fuel consumption. A direct injection engine may perform wall guide combustion, in which spray is introduced along a piston wall so that a mixture gas is led to an ignition plug. Alternatively, a direct injection engine may perform spray guide combustion, in which spray is jetted and directly ignited without being introduced by a wall.

In recent years, further improvement in fuel consumption and reduction in harmful components in exhaust gas are demanded.

U.S. Pat. Nos. 6,543,408, 6,575,132, and 6,748,917 (JP-A-2002-539365) disclose an example of the spray guide combustion, in which fuel splay is not introduced along a piston wall, so that influence may not be exerted to airflow. In this structure, the region of stratified combustion can be enlarged, and adherence of a fuel to a piston can be reduced.

U.S. Pat. No. 6,561,436 (JP-A-2002-525486) discloses a structure for jetting fuel spray in the form of a hollow conical shape. In this structure, a valve body accommodates a valve member, which is lifted outwardly from a valve seat of the valve body, thereby forming a flow passage therebetween. Fuel is jetted throughout the circumferential periphery of the flow passage to form a spray in the form of a hollow conical shape. The valve member extends through the valve body, so that the seat is relatively large in diameter. Accordingly, an actuator such as a piezoelectric element or a super magnetostrictive element is applied for producing a large driving force in order to operate the valve member.

However, in the structure of US '436, a fuel pipe needs to be additionally provided for introducing surplus fuel therethrough into a fuel tank for control of hydraulic pressure in a hydraulic pressure control chamber. For example, JP-A-4-12165 discloses a structure for driving a valve member using an actuator producing relatively small force. In this structure, the actuator adjusts flow of fuel to control hydraulic pressure in a hydraulic pressure control chamber, so that a valve member is lifted and seated corresponding to the hydraulic pressure. In this operation, surplus fuel is produced for controlling hydraulic pressure in the hydraulic pressure control chamber. This surplus fuel is returned to a fuel tank through a fuel passage. In this structure, a fuel piping system of the fuel injection apparatus becomes complicated due to the additional fuel passage. Consequently, manufacturing cost of the fuel injection system may be increased.

SUMMARY OF THE INVENTION

In view of the foregoing and other problems, it is an object of the present invention to produce a fuel injection valve having a valve member actuated by reduced hydraulic force.

According to one aspect of the present invention, a fuel injection valve injects fuel into a cylinder of an internal combustion engine. The fuel injection valve includes a valve body that faces an interior of the cylinder. The valve body surrounds a first passage connecting with the cylinder. The valve body has a valve seat. The injection valve further includes a valve member that is adapted to be seated on the valve seat. The valve member is adapted to be lifted from the valve seat. The injection valve further includes an injector body that connects with the valve body. The injector body has a pressure control chamber for controlling hydraulic pressure applied to the valve member from an opposite side of the valve seat thereby controlling a lift of the valve member. The injector body has a second passage through which fuel in the pressure control chamber is exhausted. The injection valve further includes an actuator that is adapted to communicating the pressure control chamber with the first passage through the second passage. The actuator is adapted to blocking the pressure control chamber from the first passage. The first passage introduces fuel from the pressure control chamber into the cylinder through the second passage.

A fuel injection system may include at least one of the fuel injection valve. The fuel injection system may further include a fuel tank that stores fuel. The fuel injection system may further include a fuel distribution pipe that distributes fuel to the at least one of the fuel injection valve. The fuel injection system may further include a fuel supplying unit that is provided between the fuel tank and the fuel distribution pipe. The fuel supplying unit pressure-feeds fuel stored in the fuel tank to the fuel distribution pipe.

Alternatively, a fuel injection valve apparatus is provided to a cylinder of an internal combustion engine for injecting fuel supplied from a fuel supply system into the cylinder. The fuel injection valve apparatus includes an injection valve. The injection valve includes a fuel inlet that connects with the fuel supply system. The injection valve further includes an injector body that connects with the fuel inlet, the injector body having a pressure control chamber. The injection valve further includes a valve body that connects with the injector body. The valve body faces an interior of the cylinder. The valve body has a valve seat. The injection valve further includes a valve member that is surrounded by the valve body. The valve member is movable with respect to the valve seat of the valve body. The valve member has a passage that communicates with the interior of the cylinder. The injection valve further includes an actuator. The valve member is seated on the valve seat by being applied with hydraulic pressure from the pressure control chamber at least when the actuator blocks the pressure control chamber from the passage. The valve member is lifted from the valve seat when the actuator communicates the pressure control chamber with the passage.

A fuel injection system includes the fuel injection apparatus and the fuel supply system. The fuel supply system may include a fuel tank that stores fuel. The fuel supply system may further include a fuel distribution pipe that connects with the fuel injection valve. The fuel supply system may further include a fuel supplying unit that is provided between the fuel tank and the fuel distribution pipe. The fuel supplying unit draws fuel from the fuel tank to the fuel distribution pipe.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION OF PREFERRED EMBODIMENTS

First Embodiment

Figure 1:
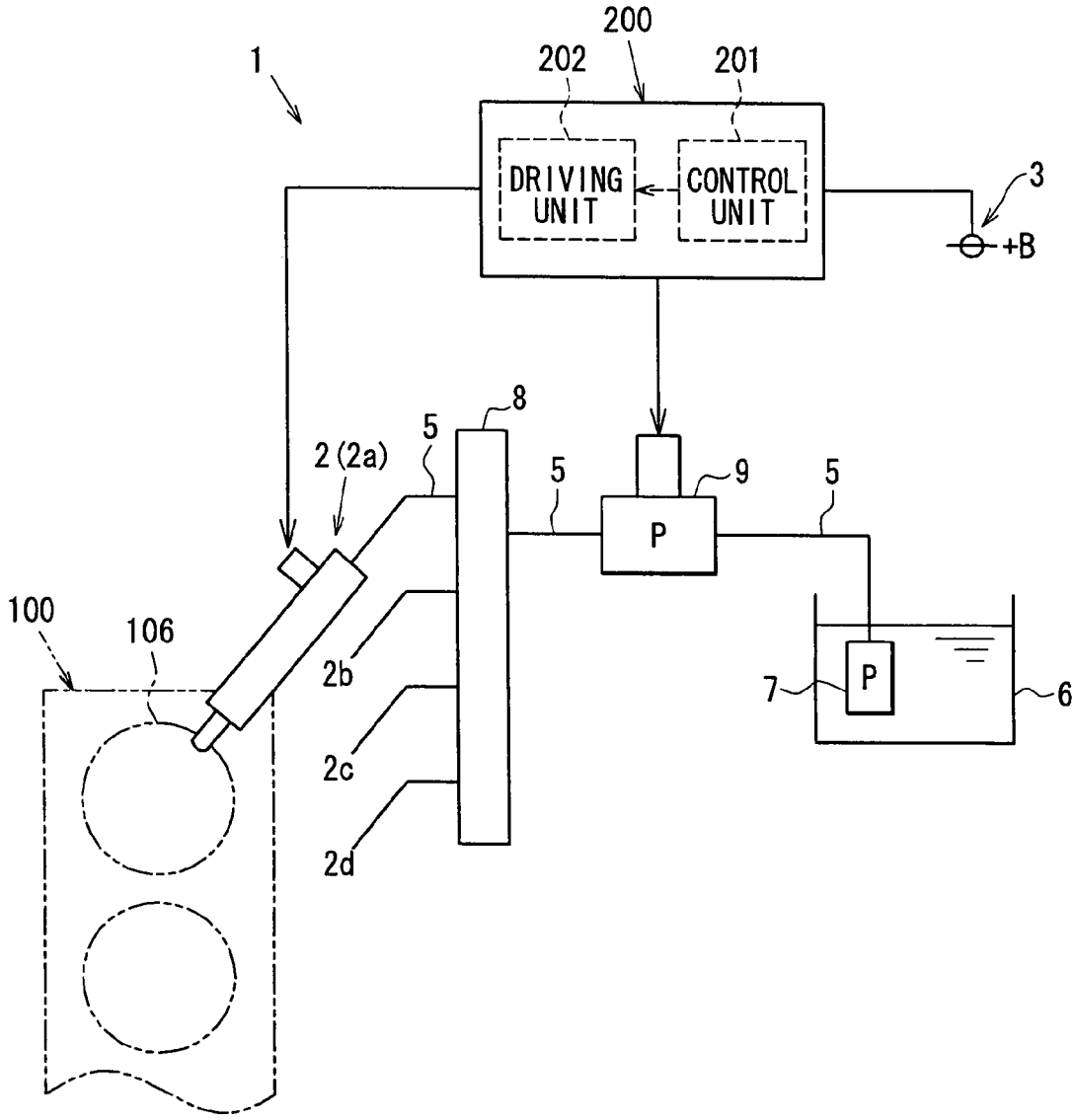
FIG. 1 is a schematic diagram showing a fuel injection system including a fuel injection valve according to a first embodiment.

As shown in FIG. 1, a fuel injection system 1 is provided to an internal combustion engine 100. The engine 100 may be a multi-cylinder gasoline engine such as a four-cylinder engine. The fuel injection system 1 includes a fuel injection apparatus that injects fuel into respective cylinders of the engine 100. The engine 100 includes combustion chambers 106 in respective cylinders. The combustion chambers 106 are increased and decreased in volume upon reciprocation of pistons. The combustion chambers 106 in the cylinders are connected to intake pipes (not shown) through intake valves (not shown) to permit intake air to be introduced thereinto. The combustion chambers 106 are connected to exhaust pipes (not shown) through exhaust valves (not shown) to discharge exhaust. In FIG. 1, only a fuel injection valve 2*a* is depicted corresponding to one cylinder among the four cylinders, and illustration of other fuel injection valves 2*b*, 2*c*, 2*d* is omitted.

The fuel injection system 1 includes the fuel injection apparatus, a fuel distribution pipe 8, a high pressure pump 9, and a control unit (electronic control unit: ECU) 200. The fuel injection apparatus includes a fuel injection valve 2 that injects fuel. The fuel distribution pipe 8 distributes and supplies fuel to the fuel injection valve 2. The high pressure pump 9 pressure-feeds fuel to the fuel distribution pipe 8. The ECU 200 controls an injecting operation of the fuel injection valve 2. The fuel injection valve 2 may be mounted obliquely into the cylinder of the engine 100, as shown in FIG. 1. Alternatively, the fuel injection valve 2 may be mounted on a substantially central upper region of the cylinder to face an interior of the cylinder. In the following description of this embodiment, the fuel injection valve 2 is assumed to be mounted centrally on the engine 100.

Fuel is pressurized by a fuel pump 7 and the high pressure pump 9, and is supplied to the fuel injection valve 2 through the fuel distribution pipe 8. For example, the high pressure pump 9 further pressurizes fuel of predetermined low pressure (for example, 0.2 MPa) drawn from a fuel tank 6 using the fuel pump 7, such that fuel being supplied to the combustion chambers 106 increase in pressure to be equal to or greater than about 2 MPa. The fuel of predetermined high pressure in such a range of 2 to 13 MPa is supplied to the fuel injection valve 2 through the fuel distribution pipe 8. Fuel discharged from the fuel pump 7 and fuel pressurized by and discharged from the high pressure pump 9, are respectively regulated to a predetermined pressure using a pressure regulator as a fuel pressure regulating device (not shown). The fuel distribution pipe 8, the high pressure pump 9, the fuel pump 7, and the fuel tank 6 construct a fuel supply system.

Figure 2:
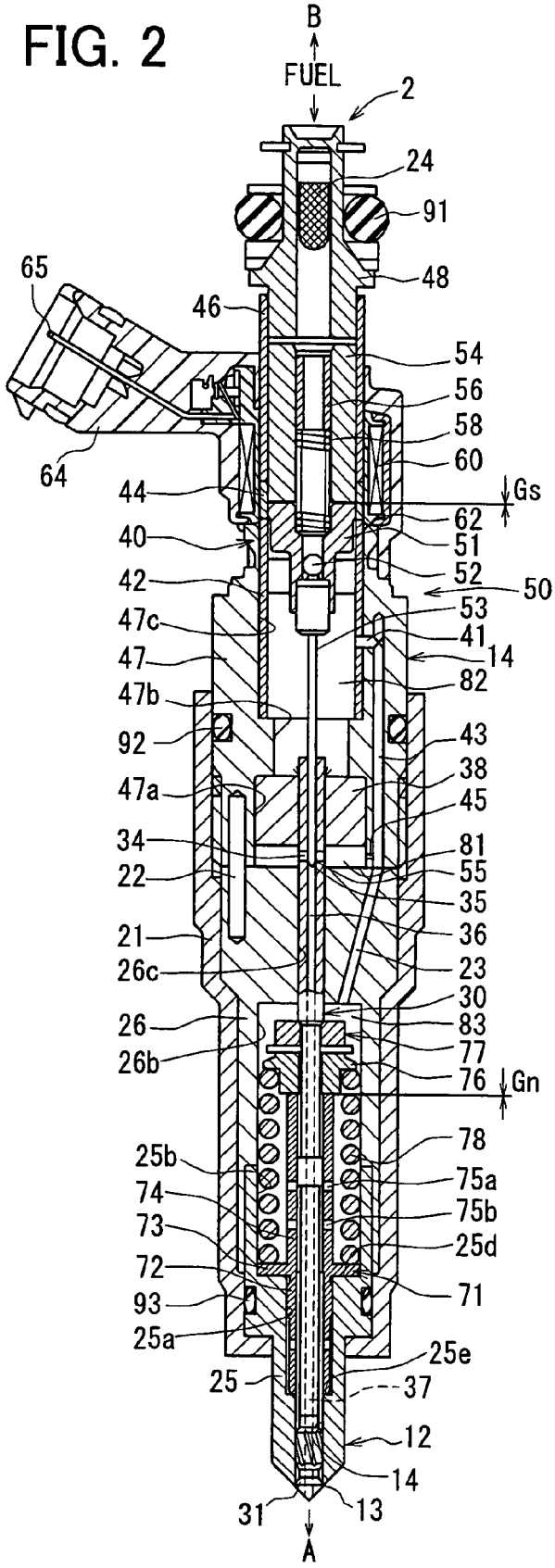
FIG. 2 is a longitudinal partially sectional view showing the fuel injection valve according to the first embodiment.

As shown in FIG. 2, the fuel injection valve 2 is in a substantially cylindrical-shape. The fuel injection valve 2 receives fuel from one end thereof, and injects fuel from the other end thereof. The fuel injection valve 2 is constructed of a valve body 12, a nozzle needle 30, a casing 14, a pressure control chamber 81 formed in the casing 14, a pressure control needle (valve element) 53, a coil 60, a stationary core 54, and a movable core 51. The nozzle needle 30 serves as a valve member. The coil 60 serves as an electromagnetic actuator. The fuel injection valve 2 has a fuel introduction part (filter body) on one end side thereof. The fuel introduction part of the fuel injection valve 2 has an inner hole, through which fuel is supplied into the fuel injection valve 2. A filter 24 is provided to the inner hole of a fuel inlet 48 to remove foreign matters.

As shown in FIG. 2, a nozzle body 25 and the casing 14 are fixed together using a retaining nut 21 and a knock pin 22 with a packing 26 as an intermediate member therebetween. The nozzle body 25 and the packing 26 construct the valve body 12. The casing 14 has a cylindrical member 40 that is fixed to a filter body 24 by welding or the like.

Figure 6:
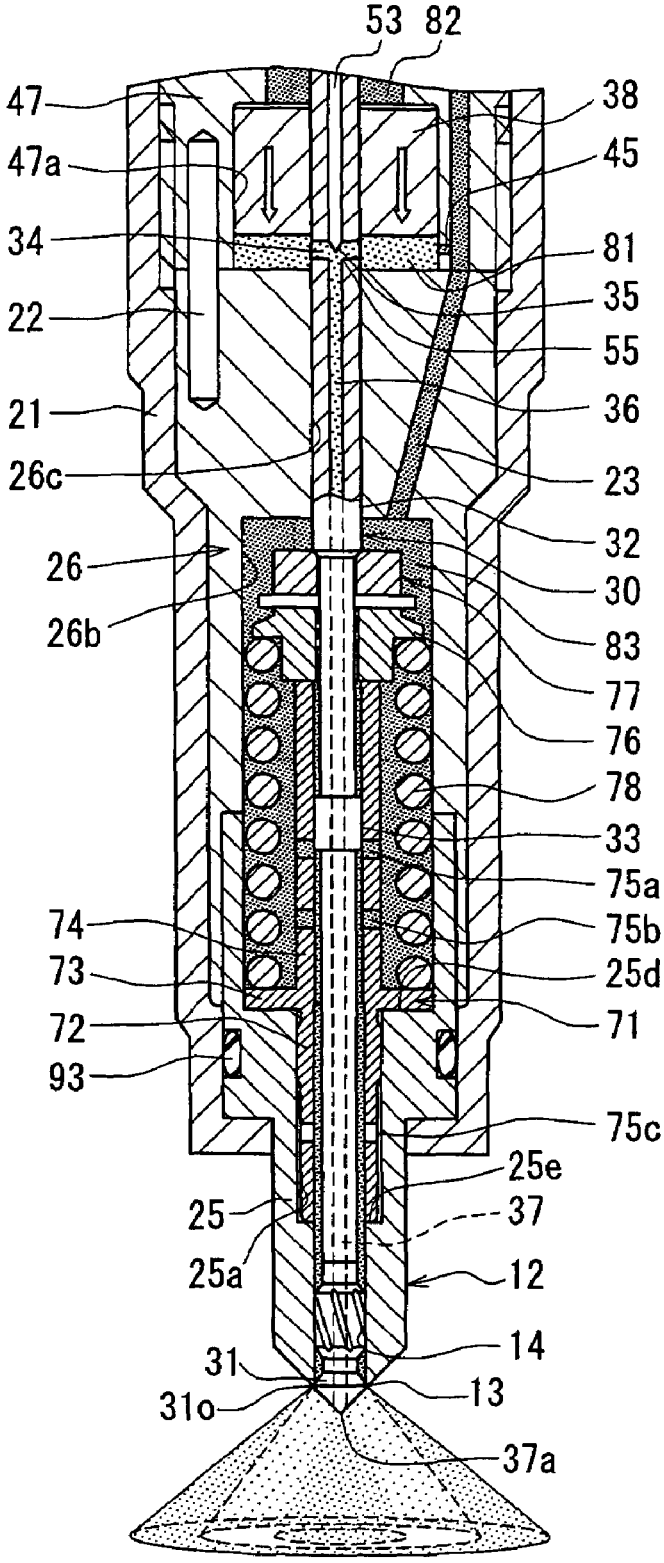
FIG. 6 is a longitudinal partially sectional view illustrating the process of fuel injection of the fuel injection valve in a state, in which the electromagnetic actuator operates and a valve member in the valve body lifts.

The nozzle body 25, the packing 26, the casing 14, and the filter body 24 define fuel passages 41, 43, 23. The fuel passages 41, 43, 23 introduce fuel to a nozzle opening 31*o* (FIGS. 6, 12B). The pressure control chamber 81 communicates with the fuel passage 43 through a fuel throttle passage (orifice passage) 45. In addition, a high-pressure fuel supplied from the fuel distribution pipe 8 flows into the fuel inlet 48 provided with the filter body 24.

The valve body 12 is not limited to the combination of the nozzle body 25 and the packing 26. The valve body 12 may be constructed of the nozzle body 25.

The nozzle body 25 has an inner peripheral surface 12*a* having substantially the same diameter with respect to a fuel flow direction. The nozzle needle 30 can be seated on and lifted from the inner peripheral surface 12*a* of the nozzle body 25. In addition, the inner peripheral surface 12*a* of the nozzle body 25 defines a valve seat 13 to permit the nozzle needle 30 to be seated thereon and lifted therefrom.

The valve seat 13 is not limited to the inner peripheral surface 12*a* having substantially the same diameter. The valve seat 13 may have a conical surface, which is increased in diameter with respect to the fuel flow direction.

Figure 12A:
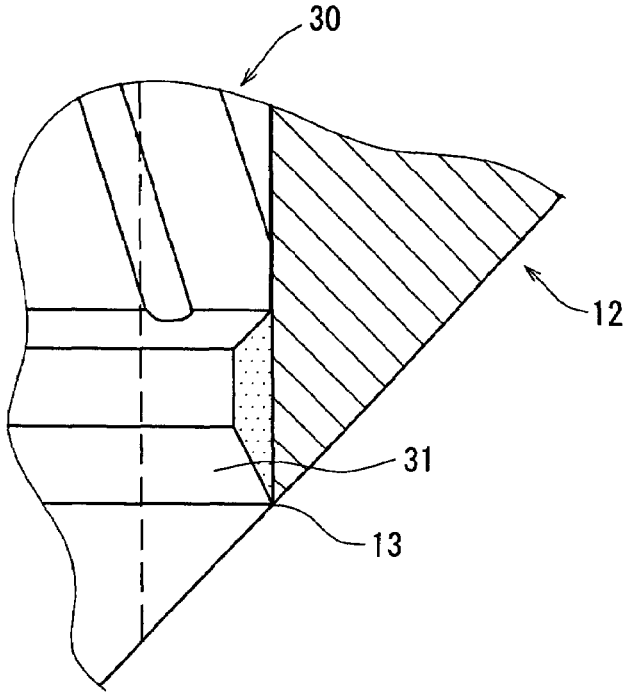
FIG. 12A is a longitudinally sectional view showing the valve member being seated on a valve seat of the valve body.
Figure 12B:
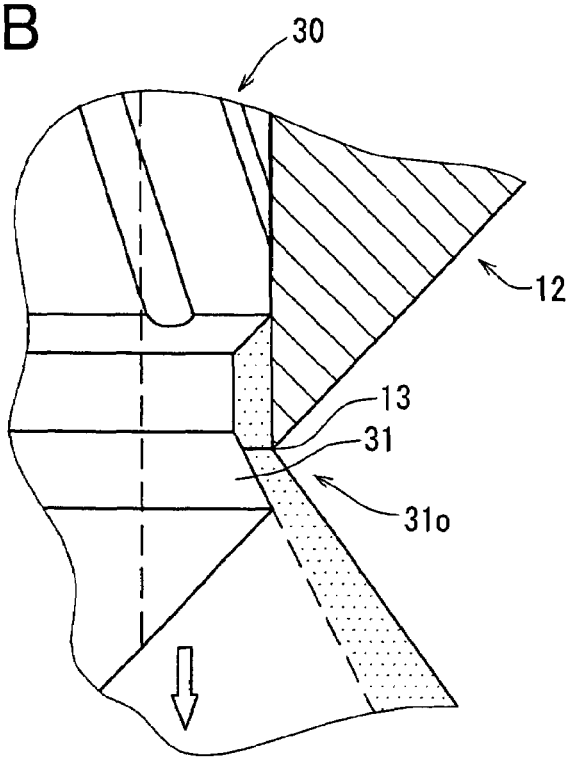
FIG. 12B is a longitudinally sectional view showing the valve member being lifted from the valve seat of the valve body.

For example, as shown in FIG. 12A, an abutment 31 of the nozzle needle 30 is seated on the valve seat 13 of the valve body 12. As shown in FIG. 12B, the abutment 31 of the nozzle needle 30 can be lifted from the valve seat 13 of the valve body 12. When the abutment 31 is lifted from the valve seat 13, as shown in FIGS. 6, 12B, a clearance (nozzle hole) 31*o* is formed all around the abutment 31 and the valve seat 13 between the valve seat 13 and the abutment 31 lifted from the valve seat 13. Thus, the nozzle opening 31*o* defines an opening, through which fuel is jetted. An opening area of the nozzle opening 31*o* increases corresponding to a lift of the nozzle needle 30. In addition, the valve seat 13 and the abutment 31 construct a seat part that oiltightly stop fuel injection.

The nozzle needle 30 is in a substantially spindle shape. The nozzle needle 30 is axially movable in the valve body 12. More specifically, the nozzle needle 30 is axially movable in the nozzle body 25 and the packing 26. A piston (hydraulically driven piston) 38 is provided to an end of the nozzle needle 30 on the opposite side of the valve seat 13. The hydraulically driven piston 38 is axially movable in the valve body 12 in conjunction with the nozzle needle 30. The hydraulically driven piston 38 is joined integrally with the nozzle needle 30 by all-around welding, or the like. In addition, the hydraulically driven piston 38 constructs the end of the valve member on the opposite side of the valve seat 13.

Figure 3:
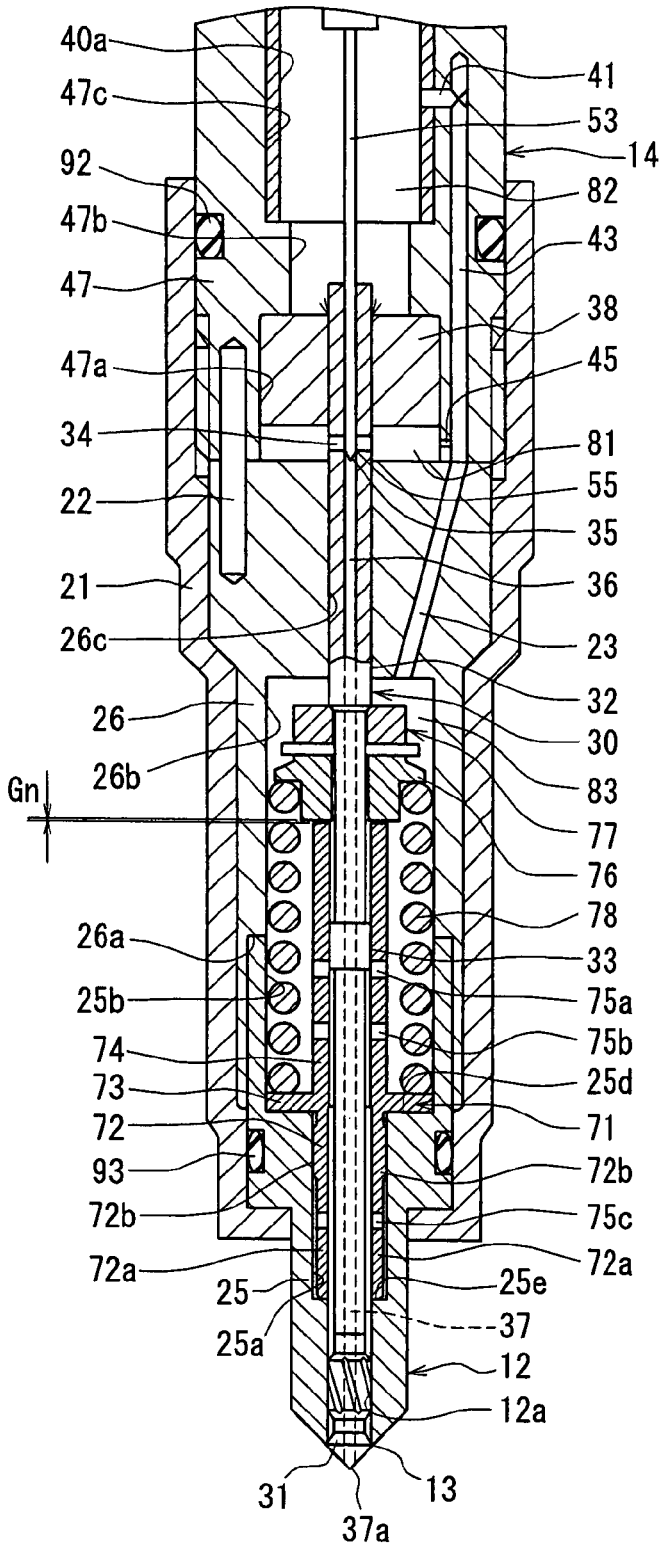
FIG. 3 is a longitudinal partially sectional view showing an injector body and a valve body of the fuel injection valve according to the first embodiment.

As shown in FIGS. 2, 3, first and second stopper members 71, 76 are provided in the nozzle body 25 and the packing 26. The first stopper member 71 abuts constantly against a part of the nozzle body 25. For example, the first stopper member 71 may abut constantly against a second step 25*e* of the nozzle body 25. As shown in FIG. 3, the spring 78 biases the nozzle needle 30 in a seated direction, in which the nozzle needle 30 is seated on the valve seat 13. The first stopper 71 and the second stopper 76 are faced to each other to interpose the spring 78 therebetween, thereby forming a predetermined axial gap (air gap) Gn. Thus, the first stopper 71 restricts a lift of the nozzle needle 30 corresponding to the air gap Gn.

In addition, a spring chamber (second back-pressure chamber) 83 is formed in the nozzle body 25 and the packing 26 to receive the stopper members 71, 76 and the spring 78. A pressurized fuel supplied from the fuel distribution pipe 8 flows into the second back-pressure chamber 83 through the fuel passages 41, 43, 23. For example, the packing 26 has inner peripheries 26*a*, 26*b*, 26*c*. The inner periphery 26*a* abuts against an upper end of the nozzle body 25 whereby an inner periphery 25*b* at an upper end thereof and the inner periphery 26*b* define the second back-pressure chamber 83. The upper end of the nozzle body 25 has stepped inner peripheries 25*a*, 25*b* in this order from the valve seat 13 upwardly in FIG. 3. The nozzle body 25 has a first step 25*d* and a second step 25*e*.

Each of the first stopper 71 and the second stopper 76 is in a substantially cylindrical-shaped. The nozzle needle 30 can be inserted through the first and second stoppers 71, 76. In addition, a clearance is formed between an outer periphery of the second stopper 76 and the inner periphery 26*b* of the packing 26 for introducing fuel therethrough.

As shown in FIG. 3, the first stopper 71 includes a lower stopper 72, a first support 73, and an upper stopper 74 from the side of the valve seat 13 upwardly in FIG. 3. The lower stopper 72 is received and held by the inner periphery 25*a* of the nozzle body 25 and abuts constantly against the second step 25*e*. The first support 73 has the outside diameter greater than that of the spring 78 to support the spring 78, so that the spring 78 is resiliently expandable. The upper stopper 74 is in a substantially cylindrical-shape, so that the upper stopper 74 resiliently guides the spring 78.

In addition, the first support 73 is preferably arranged in opposition to the first step 25*d* of the nozzle body 25 with respect to the axial direction thereof. That is, an axial clearance is preferably formed between the first support 73 and the first step 25*d*.

The upper stopper 74 of the first stopper 71 has communication holes (first communication holes) 75*a*, 75*b*, which radially extend from the inside to the outside of the upper stopper 74. Thereby, even when the needle 30 maximally lifts and the air gap Gn disappears, fuel can be maintained to flow toward the valve seat 13 through the fuel passages 41, 43, 23, the second back-pressure chamber 83, the outer periphery of the second stopper 76, and the inner periphery of the first stopper 71.

Furthermore, the lower stopper 72 includes a large-diameter cylindrical portion 72*b* and a small-diameter portion 72*a*. The large-diameter cylindrical portion 72*b* is slidable on the inner periphery 25*a*. The small-diameter cylindrical portion 72*a* extends from the large-diameter cylindrical portion 72*b* toward the valve seat 13. The small-diameter cylindrical portion 72*a* and the inner periphery 25*a* of the nozzle body 25 define a radial clearance space therebetween.

Furthermore, as shown in FIG. 3, the lower stopper 72 has a second communication hole 75*c*, which serves as a fuel communication hole for communicating the radial clearance space around the nozzle body 25 with the inner fuel passage defined radially in the nozzle body 25.

The second stopper 76 includes a body, as a second support holding the spring 78, and a hooking member 77 that hooks to the nozzle needle 30. The second stopper 76 is not limited to have a structure, in which the body and the hooking member 77 are assembled, but may have a structure, in which the body and the hooking member 77 are integrally formed. In the following descriptions of this embodiment, the second stopper 76 is assumed to have a structure, in which the body and the hooking member 77 are separately formed and are assembled together. By forming the hooking member 77 as a member separate from the second stopper 76, the air gap Gn becomes adjustable such that the air gap Gn can be determined by a thickness of the hooking member 77 in an assembling process thereof.

As shown in FIG. 2, the downstream side of the valve seat 13 with respect to the fuel flow opens to the outside of the fuel injection valve 2. The abutment 31 of the nozzle needle 30 is seated on and lifted from the valve seat 13 whereby fuel is injected from the nozzle opening 31*o* and the fuel injection is terminated. More specifically, the nozzle needle 30 lifts in the direction A in FIG. 2 whereby the nozzle needle 30 is lifted from the valve seat 13 and the inner fuel passage communicates with the outside of the fuel injection valve 2 to permit fuel to be jetted through the nozzle opening 31*o*. On the other hand, the nozzle needle 30 moves in the direction B in FIG. 2 whereby the nozzle needle 30 is seated on the valve seat 13 to attain closure between the downstream side of the valve seat 13 and the inner fuel passage to stop the fuel injection. In addition, the direction A is referred to a valve opening direction and the direction B is referred to a valve closing direction in the following descriptions of the embodiment. In addition, a fuel injection quantity of the fuel injection valve 2 is metered by the lift of the nozzle needle 30 and a valve opening period. When the nozzle needle 30 is seated on the valve seat 13, fuel injection is stopped. When the nozzle needle 30 is lifted from the valve seat 13, fuel is jetted.

The casing 14 includes the cylindrical member 40 and a casing body 47. The cylindrical member 40 is inserted into an inner periphery 47*c* of the casing body 47 from the opposite side of the valve seat 13, and is fixed to the casing body 47 by welding or the like.

The cylindrical member 40 includes a first magnetic cylinder 42, a non-magnetic cylinder 44, and a second magnetic cylinder 46 in this order from the side of the valve seat 13. The non-magnetic cylinder 44 restricts magnetic shortcut between the first magnetic cylinder 42 and the second magnetic cylinder 46. When the coil 60 is supplied with electricity, magnetic flux efficiently flows to generate magnetic attractive force between the stationary core 54 and a movable core 51.

The casing body 47 includes stepped inner peripheries 47*a*, 47*b*, 47*c*. The inner periphery 47*c* is fixed to the outer periphery of the cylindrical member 40. The inner periphery 47*b* receives the nozzle needle 30 and the pressure control needle 53 in an insertable manner. The inner periphery 47*a* slidably receives the hydraulically driven piston 38.

A pressure control chamber 81 is formed at the end of the hydraulically driven piston 38 on the side of the valve seat 13. The pressure control chamber 81 is compartmented by the end surface (lower end surface) of the hydraulically driven piston 38 on the side of the valve seat 13, the inner periphery 47*a*, and the upper end surface of the packing 26. The pressure control chamber 81 communicates with the orifice passage 45, so that high-pressure fuel supplied to the fuel injection valve 2 passes through the orifice passage 45.

The nozzle needle 30 is arranged in the pressure control chamber 81. Fuel in the pressure control chamber 81 is capable of passing through discharge flow passages 34, 36 formed in the nozzle needle 30. The discharge flow passage 36 extends axially through the nozzle needle 30. The discharge flow passage 34 defines a communication passage that communicates the discharge flow passage 36 arranged inside the nozzle needle 30 with the pressure control chamber 81.

The pressure control needle 53 is axially slidable through the upper end of the nozzle needle 30 in FIG. 3. A tip end 55 of the pressure control needle 53 can be seated on and lifted from a needle seat (valve element seat) 35 formed in the discharge flow passage 36.

The discharge passages 36, 37 include an in-cylinder discharge flow passage 37. In this embodiment, the in-cylinder discharge flow passage 37 extends to the tip end of the nozzle needle 30. The tip end of the nozzle needle 30 faces the combustion chamber 106 of the fuel injection valve 2. The in-cylinder discharge flow passage 37 has an opening 37*a* in the tip end of the nozzle needle 30 on the side of the combustion chamber 106. Thereby, fuel discharged through the discharge flow passages 36, 37 from the pressure control chamber 81 is jetted directly to the combustion chamber 106 through the opening 37*a* of the in-cylinder discharge flow passage 37.

The in-cylinder discharge flow passage 37 may serve as a first passage. The discharge flow passage 34 may serve as a second passage.

The opening 37*a* may be a single hole or multiple holes. It is assumed below in the embodiment that the opening 37*a* is a single hole.

The tip end 55 of the pressure control needle 53 serves as an abutment that can be seated on and lifted from the needle seat 35. The tip end 55 and the needle seat 35 construct a seat part that oiltightly stops injection of fuel discharged from the pressure control chamber 81 through the discharge flow passages 36, 37.

In addition, a first back-pressure chamber 82 is provided at the end of the hydraulically driven piston 38 toward the valve seat 13. The first back-pressure chamber 82 is communicated to the pressure control chamber 81 through a slide clearance (first slide clearance) between the hydraulically driven piston 38 and the inner periphery 47*a* of the casing body 47. Further, the first back-pressure chamber 82 is communicated to the pressure control chamber 81 through a slide clearance (second slide clearance) between the pressure control needle 53 and the discharge flow passage 36. Also, a second back-pressure chamber 83 is communicated to the pressure control chamber 81 through a slide clearance (third slide clearance) between the inner periphery 26*c* of the packing 26 and the nozzle needle 30. In addition, the first slide clearance, the second slide clearance, and the third slide clearance construct fuel throttle clearances, by which high pressure fuel in the respective back-pressure chambers 82, 83 is restricted in flowing into the pressure control chamber 81.

As shown in FIG. 2, the electromagnetic actuator includes the coil 60, the stationary core 54, and the movable core 51. The movable core 51 is made of a magnetic material to be in the form of a substantially cylindrical-shaped body with a step, and fixed to the end of the pressure control needle 53 on the opposite side of the valve seat 13 by welding or the like. The movable core 51 is movable together with the pressure control needle 53. An outflow hole 52 extends through a cylindrical wall of the movable core 51. The outflow hole 52 forms a fuel passage that provides communication inside and outside the movable core 51.

In addition, the movable core 51 and the pressure control needle 53 construct a valve element 50.

The stationary core 54 is made of a magnetic material to be in the form of a substantially cylindrical-shaped body. The stationary core 54 is inserted into the cylindrical member 40 and fixed to the cylindrical member 40 by welding. The stationary core 54 is mounted on the opposite side of the valve seat 13 with respect to the movable core 51. The stationary core 54 faces the movable core 51. The stationary core 54 and the movable core 51 are arranged in opposition to each other with a predetermined air gap Gs therebetween. The air gap Gs is equivalent to a lift HD2, by which the pressure control needle 53 can separate from the needle seat 35.

An adjusting pipe 56 is press-fitted into the inner periphery of the stationary core 54 to define a fuel passage therein. A spring 58 as a bias member engages at one end thereof with the adjusting pipe 56 and at the other end thereof with the movable core 51. By regulating an extent, to which the adjusting pipe 56 is press-fitted, a load of the spring 58 exerted on the movable core 51 is changed. The bias of the spring 58 causes the movable core 51 and the pressure control needle 53 to be biased toward the needle seat 35. In other words, the spring 58 serves as a bias unit that biases the movable core 51 in a direction, in which the pressure control needle 53 is seated.

The coil 60 is wound around a spool 62, or the like. A terminal 65 is insert-molded in a connector 64, or the like and electrically connected to the coil 60. Upon energization of the coil 60, magnetic attractive force is generated between the movable core 51 and the stationery core 54, so that the movable core 51 is attracted toward the stationary core 54 against the bias of the spring 58.

The electromagnetic actuators 60, 54, 50 construct an actuator, which switches a fuel flow between the pressure control chamber 81 and the discharge flow passage 36 to cut-off (block) or communication. The valve element 50 is seated on and lifted from the needle. seat 35 whereby the valve element 50 switches a fuel flow between the pressure control chamber 81 and the discharge flow passage 36 to cut-off or communication.

As shown in FIG. 2, the inner fuel passage of the fuel injection valve 2 is formed from the upstream of a fuel flow to the downstream. The inner fuel passage is formed in the order of an inner periphery of the filter body 24, an inner periphery of the adjusting pipe 56, the inner periphery of the stationary core 54, the outflow hole (radial passage) 52 of the movable core 51, an inner periphery of the cylindrical member 40, the inner periphery 47*b* of the casing body 47, the fuel passages 41, 43, 23, the second back-pressure chamber 83, an outer periphery of the second stopper 76, the inner periphery of the first stopper 71, and an inner periphery 25*a* of the nozzle body 25, these elements constituting an inner fuel passage as a flow path of fuel directed toward the jet nozzle 21.

The nozzle needle 30 is arranged in the inner fuel passage such that the nozzle needle 30 is cooled by fuel supplied to the fuel injection valve 2.

The first back-pressure chamber 82 is defined by the inner periphery of the filter body 24, the inner periphery of the adjusting pipe 56, the inner periphery of the stationary core 54, the outflow hole (radial passage) 52 of the movable core 51, the inner periphery of the cylindrical member 40, and the inner periphery 47*b* of the casing body 47.

As shown in FIG. 1, the ECU 200 as control unit is constructed as a microcomputer of a general construction, in which a read-only memory (ROM), a random access memory (RAM), a microprocessor (CPU), an input port, and an output port are connected to one another by a two-way bus. The ECU 200 electrically connects with an electric power supply 3 such as a battery. The ECU 200 starts and stops energization of the coil 60 of the fuel injection valve 2 to control a period, during which the fuel injection valve 2 is energized. Signals of various sensors (not shown), which detect an operating condition of an engine such as engine speed, intake pipe pressure (or intake air quantity), cooling water temperature are read, so that operations of the electromagnetic actuators 60, 54, 50 of the fuel injection valve 2 are controlled according to various programs (not shown), for the engine. In addition, the ECU 200 supplies an electric current to the terminal 65 of the fuel injection valve 2 in a predetermined direction on the basis of signals of various sensors, which detect an operating condition of the engine.

The fuel injection valve 2 is provided in the direct injection engine 100 to jet high pressure fuel at pressure such as in the range of 2 to 13 MPa. The ECU 200 includes a control circuit 201 and a drive circuit (EDU) 202. The drive circuit (EDU) 202 has a booster circuit, which drives the fuel injection valve 2. The EDU 202 boosts voltage such as 12 V of the electric power supply 3 to high voltage such as 150 V.

Subsequently, an operation of the fuel injection valve 2 of this embodiment is described. The fuel pump 7 is operated by putting an engine key of a vehicle at the IG position, and turning an ignition key (not shown) ON, for example. Fuel is drawn from the fuel tank 6 using the fuel pump 6. The drawn fuel is regulated in pressure by a pressure regulator, and the fuel at a predetermined low pressure is supplied to the high pressure pump 9. The fuel at the predetermined low pressure is pressurized by the high pressure pump 9 and the pressurized fuel is supplied to the fuel distribution pipe 8. The fuel supplied to the fuel distribution pipe 8 is regulated in pressure by a pressure regulator, thereby being supplied to the fuel injection valves 2 from respective distribution ports in the fuel distribution pipe 8.

A process of fuel injection of the fuel injection valve 2 will be described below with reference to FIGS. 4 to 7. In FIGS. 4 to 7, dark hatching represents fuel, which is in the inner fuel passage of the fuel injection valve 2, being high pressure. Light hatching represents fuel reduced in pressure.

Next, stoppage of injection is described.

Figure 4:
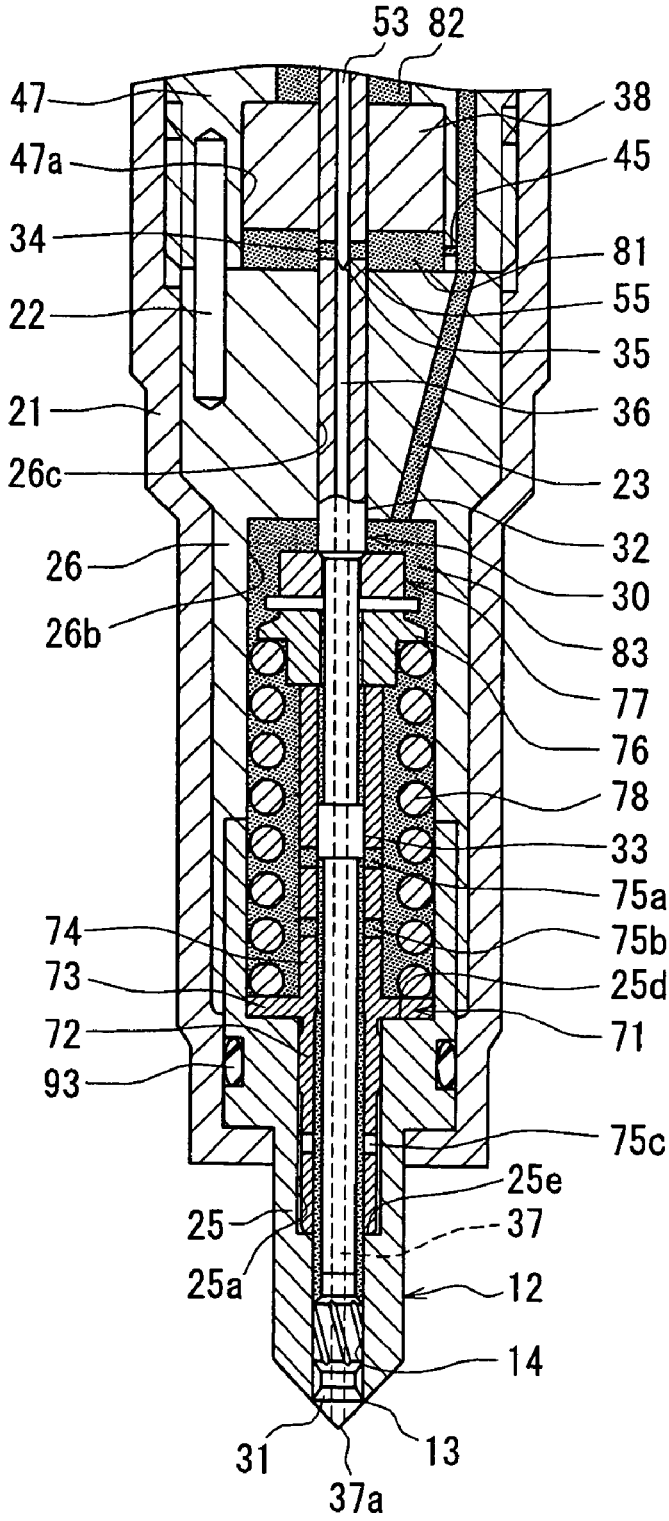
FIG. 4 is a longitudinal partially sectional view illustrating a process of fuel injection of the fuel injection valve in a state, in which an electromagnetic actuator of the fuel injection valve terminates an operation thereof.

As shown in a state, in which the electromagnetic actuators are not operated, in FIG. 4, supplying of an electric current to the coil 60 of the fuel injection valve 2 is stopped, so that the pressure control needle 53 is seated on the needle seat 35. Due to closure of the pressure control needle 53, fuel in the pressure control chamber 81 is not discharged into the discharge flow passages 34, 36. Fuel flowing into the pressure control chamber 81, the first back-pressure chamber 82, the second back-pressure chamber 83, the fuel passages 41, 43, 23, and the orifice passage 45 is filled with a high pressure fuel supplied to the coil 60 of the fuel injection valve 2. Thereby, hydraulic pressures in the pressure control chamber 81 and the first back-pressure chamber 82 is the same as each other, and both hydraulic pressures cancel each other, so that any hydraulic pressure is not applied to the hydraulically driven piston 38. Since hydraulic pressure acting in the valve opening direction A is not applied to the nozzle needle 30, the nozzle needle 30 blocks the passage to block up the nozzle opening 31*o*. Accordingly, fuel is not jetted from the opening 37*a* of the in-cylinder discharge flow passage 37 and the nozzle opening 31*o*.

Next, an operation of sub-injection from the opening 37*a* of the in-cylinder discharge flow passage 37 is described.

Figure 5:
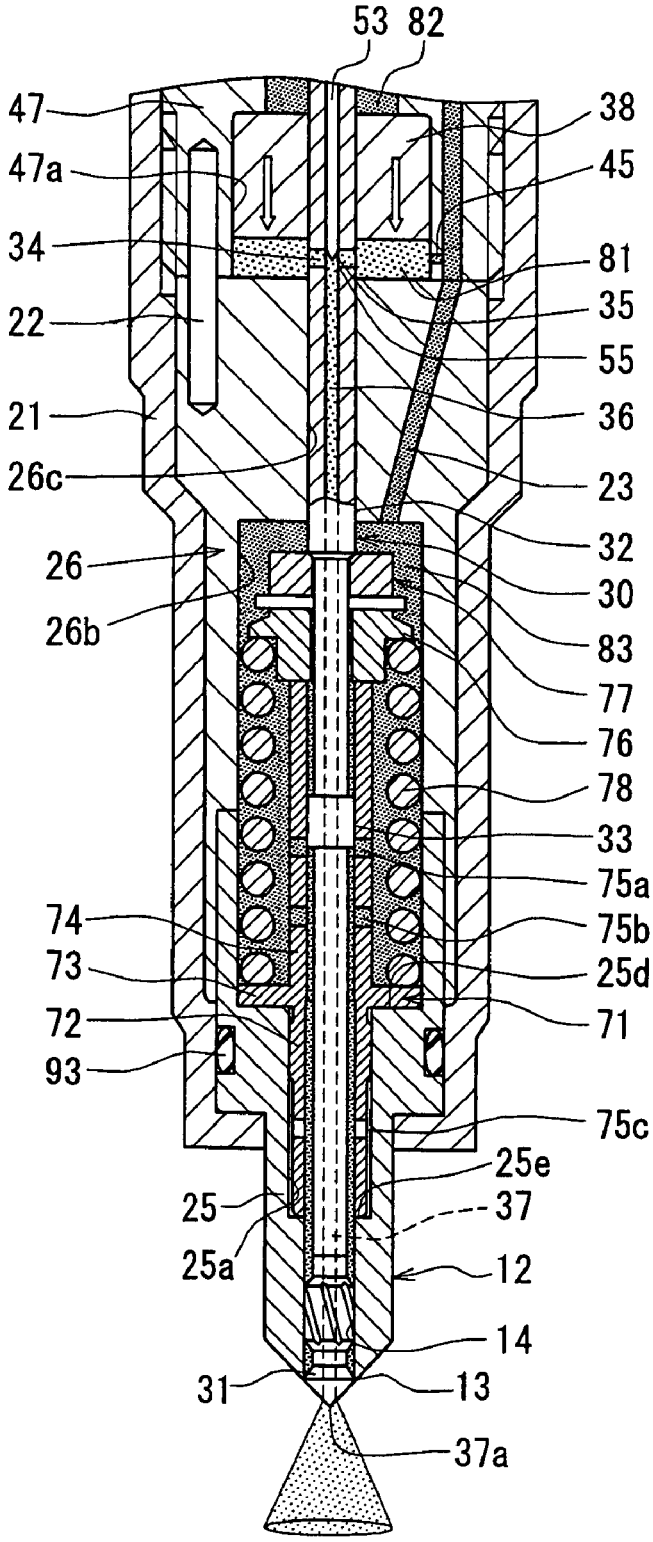
FIG. 5 is a longitudinal partially sectional view illustrating the process of fuel injection of the fuel injection valve in a state, in which the electromagnetic actuator starts the operation.

As shown in FIG. 5, electric current is supplied to the coil 60, and electromagnetic force is generated in the coil 60, so that the operation of the electromagnetic actuators is started. Thereby, the movable core 51 is attracted toward the stationary core 54, so that the pressure control needle 53 is lifted from the needle seat 35, and the pressure control needle 53 communicates the passage between the pressure control chamber 81 and the discharge flow passage 36. When the pressure control needle 53 communicates the passage, fuel in the pressure control chamber 81 flows into the discharge flow passage 36. The fuel flowing into the discharge flow passage 36 is jetted from the opening 37*a* of the in-cylinder discharge flow passage 37 to form a fuel spray (sub-spray) in the form of, for example, a substantially conical shape.

At this time, fuel flows out of the discharge flow passage 36 whereby fuel in the pressure control chamber 81 is reduced in pressure. Hydraulic pressure in the pressure control chamber 81 is reduced relative to hydraulic pressure in the first back-pressure chamber 82, so that hydraulic pressure in a direction indicated by arrows in FIG. 5 acts on the hydraulically driven piston 38. The pressure control chamber 81 is reduced in pressure, so that total hydraulic pressure of the pressure control chamber 81 and the first back-pressure chamber 82 applied downwardly in FIG. 5 increases. The nozzle needle 30 is not lifted from the valve seat 13 until the total hydraulic pressure becomes greater than the bias of the spring 78 applied upwardly in FIG. 5, even when the hydraulic total pressure increases. In this state, fuel is not jetted from the nozzle opening 31*o*.

Next, an operation of sub-injection from the opening 37*a* and primary injection from the nozzle opening 31*o* are described.

As shown in FIG. 6, when the total hydraulic pressure increases to overcome the bias of the spring 78, the nozzle needle 30 is lifted from the valve seat 13 against the bias of the spring 78, so that the nozzle opening 31*o* is opened. The opening area of the nozzle opening 31*o* increases according to the lift of the nozzle needle 30. Fuel is jetted from the nozzle opening 31*o* to form fuel spray (primary spray) in the form of, for example, a substantially hollow conical shape.

At this time, the sub-injection from the opening 37*a* is arranged inside the primary spray from the nozzle opening 31*o*.

Next, stoppage of the injection is described.

Figure 7:
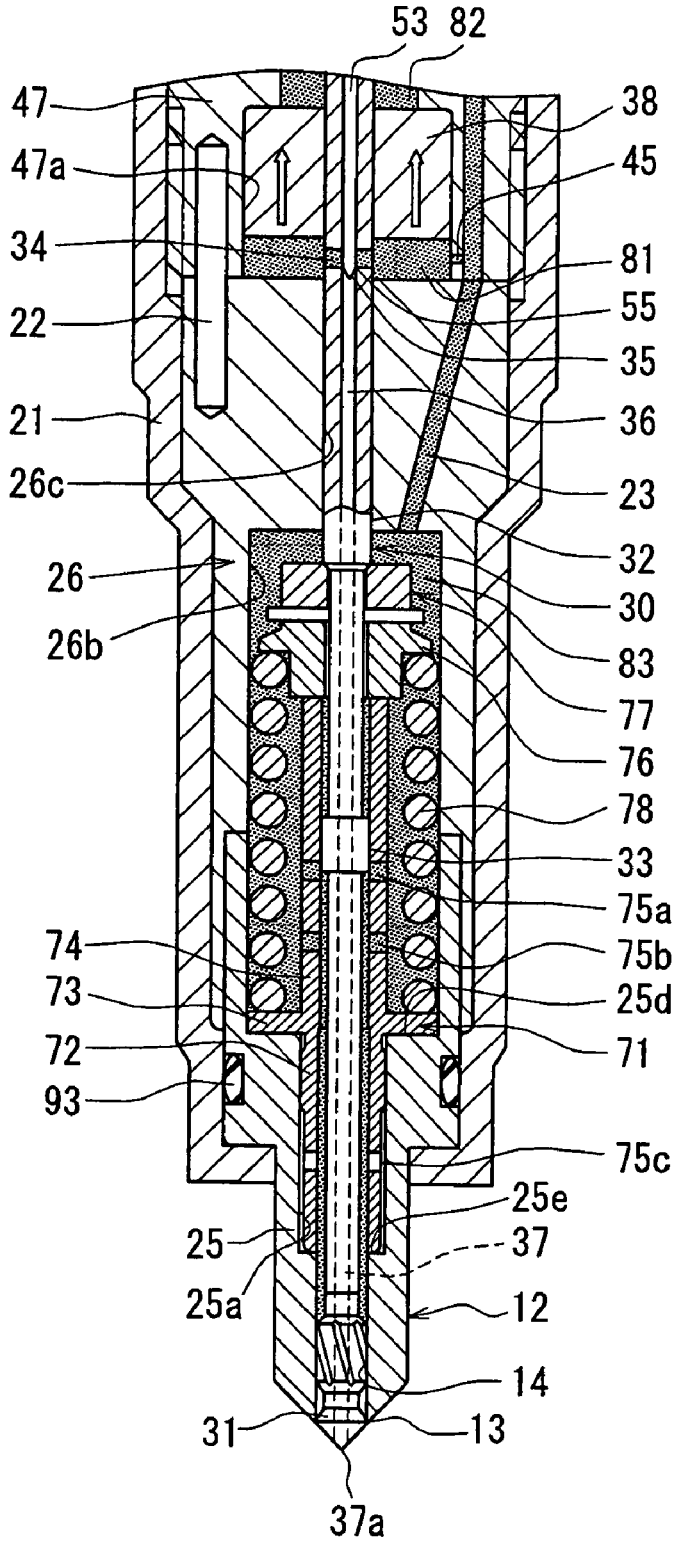
FIG. 7 is a longitudinal partially sectional view illustrating the process of fuel injection of the fuel injection valve in a state, in which the electromagnetic actuator terminates the operation thereof.

As shown in FIG. 7, supplying an electric current to the coil 60 is terminated, so that the coil 60 of the electromagnetic actuator stops generating electromagnetic force. In this condition, the pressure control needle 53 is pushed against the needle seat 35 by the spring 58, so that the pressure control needle 53 blocks the passage between the pressure control chamber 81 and the discharge flow passage 36.

When the pressure control needle 53 blocks the passage, sub-spray from the opening 37*a* of the in-cylinder discharge flow passage 37 is terminated. Owing to the blockade of the passage by the pressure control needle 53, fuel pressure in the pressure control chamber 81 is restored to become equal to pressure in the first back-pressure chamber 82. Since the total hydraulic pressure applied to the valve opening direction A decreases, the lift of the nozzle needle 30 decreases by the bias of the spring 78, so that the nozzle needle 30 is seated on the valve seat 13, and the nozzle opening 31*o* is blocked. Thus, the primary spray is terminated by blocking the nozzle opening 31*o* with the nozzle needle 30.

Subsequently, a function and an effect of this embodiment are described. The pressure control chamber 81 controls hydraulic pressure applied to the end of the nozzle needle 30 on the opposite side of the valve seat 13. For example, the hydraulic pressure is applied to the hydraulically driven piston 38 connected to the nozzle needle 30. Fuel in the pressure control chamber 81 is discharged through the discharge flow passage 36. The electromagnetic actuators 60, 54, 50 as an actuator switches a fuel flow between the pressure control chamber 81 and the discharge flow passage 36 to cut-off or communication. By this structure, the lift of the nozzle needle 30 is controlled. Drive force of the actuator for controlling the lift of the nozzle needle 30 can be made relatively small, so that the actuator suffices to cause flowing-out and cut-off of fuel in the pressure control chamber 81.

Further, fuel in the pressure control chamber 81, which is for control of hydraulic pressure, is jetted into the combustion chamber 106 from the in-cylinder discharge flow passage 37, so that fuel left over in the pressure control chamber 81 can be consumed. Therefore, an additional fuel pipe need not be formed for recovery of the left over fuel into a low pressure system such as the fuel tank 6. In addition, a fuel injection valve such as a fuel piping system can be restricted from becoming complex.

The in-cylinder discharge flow passage 37, through which fuel is jetted into the combustion chamber 106, is formed inside the nozzle needle 30. The opening 37*a* of the in-cylinder discharge flow passage 37 is formed in the tip end of the nozzle needle 30, so that the opening 37*a* faces the combustion chamber 106. In this structure, the construction can be simplified.

Generally, an unburned fuel remaining in a jet nozzle may cause a chemical reaction other than combustion, and impurities in fuel may become deposit such as carbon compound. When deposit adheres to a jet nozzle, a quantity of fuel injection may be decreased or varied.

In contrast, according to this embodiment, the in-cylinder discharge flow passage 37 is formed inside the nozzle needle 30, which is constantly cooled by fuel in the inner fuel passage of the fuel injection valve 2. Accordingly, it is possible to restrict deposit from adhering to the opening 37*a*, through which sub-injection is performed.

According to this embodiment, the actuator is constructed of the valve elements 53, 51, which switch the fuel flow between the pressure control chamber 81 and the discharge flow passage 36 to cut-off or communication. The electromagnetic actuators 60, 54 drive the valve elements 53, 51 with electromagnetic forces. Thereby, electromagnetic actuators such as a solenoid having relatively small drive force can be used instead of piezoelectric elements such as piezo elements having relatively large drive force.

According to this embodiment, the nozzle needle 30 is constructed of the needle seat 35, which enables the valve elements 53, 51 to be seated thereon and lifted therefrom, and the discharge flow passage 36 arranged downstream of the needle seat 35. In this structure, the electromagnetic actuators 60, 54, 50 serving as an actuator device are arranged coaxially with respect to the nozzle needle 30. The valve element 50 of the electromagnetic actuators is lifted from and seated on the needle seat 35, which is formed on the nozzle needle 30.

Thereby, drive force required for. driving the nozzle needle 30 becomes sufficient to overcome a load of fuel pressure acting on the seat area of the valve element 50, which is lifted from the needle seat 35, that is, the needle seat of the pressure control needle 53. Accordingly, fuel spray jetted into the combustion chamber 106 can be formed by small drive force.

According to this embodiment, the nozzle needle 30 and the valve body 12 constructs an outwardly opened valve structure, in which the nozzle needle 30 is axially slidable in the valve body 12 and the nozzle needle 30 is lifted axially outwardly from the valve seat 13, thereby forming the nozzle opening 31*o*.

In this construction, the fuel injection valve 2 can produce the primary spray, which is in the form of a substantially hollow conical shape, supplied into the cylinder. In addition, the fuel injection valve 2 can produce the sub-injection of fuel from the pressure control chamber 81 into the cylinder through the in-cylinder discharge flow passage 37.

Generally, when a conical fuel spray, which is in the form of a substantially hollow conical shape, is jetted from the fuel injection valve having the outwardly opened valve structure, the conical fuel spray has a hollow central space. Therefore, it is difficult to effectively utilize air in the cylinder such as the combustion chamber 106 or the like.

In contrast, according to this embodiment, sub-spray is jetted from the opening 37*a* of the in-cylinder discharge flow passage 37, and the sub-spray can be arranged inside the conical primary spray. Accordingly, air in the cylinder can be effectively utilized for combustion by the combination of the conical primary spray and the sub-spray.

In addition, the sub-spray is wrapped by the primary spray, so that combustion of the primary spray can activate combustion of the sub-spray when primary spray is ignited by an ignition device.

Since the fuel spray is rapidly increased in mean particle diameter (Sauter mean diameter, SMD) on the low pressure side, in which fuel pressure is equal to or less than 1.5 MPa, it is difficult to maintain a favorable state of spray. Therefore, pressure of fuel discharged into the discharge flow passage 36 is preferably equal to or larger than 1.5 MPa. Thereby, fuel spray jetted from the in-cylinder discharge flow passage 37 can be maintained in a favorable state of atomization.

According to this embodiment, an injection quantity of sub-spray jetted from the in-cylinder discharge flow passage 37 is preferably equal to or less than 30% of the primary spray.

Thereby, the sub-spray can be restricted from worsening combustion, apart from primary spray. Accordingly, the sub-spray can be produced from the in-cylinder discharge flow passage 37 without impeding combustion of conical primary spray.

In the case where an ignition device ignites spray of fuel jetted from the fuel injection valve 2, it is generally considered that an ignition device ignites fuel spray in the form of, for example, a substantially hollow conical shape or a substantially conical shape. In this case, sub-spray from the in-cylinder discharge flow passage 37, which is not ignited directly by the ignition device, preferably takes a long time, during which it mixes with an air. In contrast, according to this embodiment, sub-spray from the in-cylinder discharge flow passage 37 starts injection earlier than primary spray in the form of a substantially hollow conical shape, so that a period until ignition by the ignition device can be extended.

According to this embodiment, the fuel injection valve 2 is substantially central-mounted such that the fuel injection valve 2 is arranged centrally on the substantially central, upper region of the cylinder to face the combustion chamber 106.

Thereby, the central-mounting structure of the fuel injection valve 2 and formation of the primary spray in the form of a substantially hollow conical shape are advantageous to form a stratified combustion (spray guide combustion). In addition, the sub-injection from the in-cylinder discharge flow passage 37 is capable of effectively utilizing air in the cylinder by combining the primary injection and the sub-injection.

Generally, in the case where fuel pressure-fed from the fuel tank 6 to be supplied to the fuel injection valve 2 is partially returned to the fuel tank 6, temperature of fuel may increase. In particular, when fuel is pressure-fed at high pressure, the fuel is compressed to be in a high pressure condition, consequently fuel supplied to the fuel injection valve 2 may be vaporized.

In contrast, according to this embodiment, the fuel injection system 1 includes the fuel injection valve 2 and the high pressure fuel supplying unit 9. The high pressure fuel supplying unit 9 is provided between the fuel tank 6 with fuel stored therein and the fuel distribution pipe 8, which distributes and supplies fuel to the fuel injection valve 2. The high pressure fuel supplying unit 9 pressure-feeds fuel stored in the fuel tank 6 toward the fuel distribution pipe 8 at high pressure. All of fuel being supplied to the fuel injection valve 2 is jetted into and consumed in the combustion chamber 106. Accordingly, fuel, which is apt to be evaporated, can be restricted from being increased in temperature.

According to this embodiment, the combination of the primary spray and the sub-spray enables making effective use of air (in-cylinder air) in the cylinder. Therefore, uniformity of a mixture of air and fuel can be enhanced.

Thus, a load range of primary injection of the outwardly opened valve structure can be increased in a spray guide combustion system, in which injection from the fuel injection valve 2 is made in the compression stroke of combustion cycle of the engine 100. Thus, stratified combustion (stratified lean combustion) can be produced.

Further, in the case where injection from the fuel injection valve 2 is performed in the intake stroke, intake air flowing into the combustion chamber 106 through the intake valve can be efficiently cooled by utilizing latent heat of vaporization of fuel jetted from the fuel injection valve 2 as the primary spray and the sub-spray. The hereby, the amount of intake air flowing into the combustion chamber 106 can be increased, so that antiknock performance can be improved by enhancing uniformity. Thus, output power and fuel consumption can be improved.

In addition, the structure of the fuel injection valve 2 is not limited to the above structure.

Figure 8:
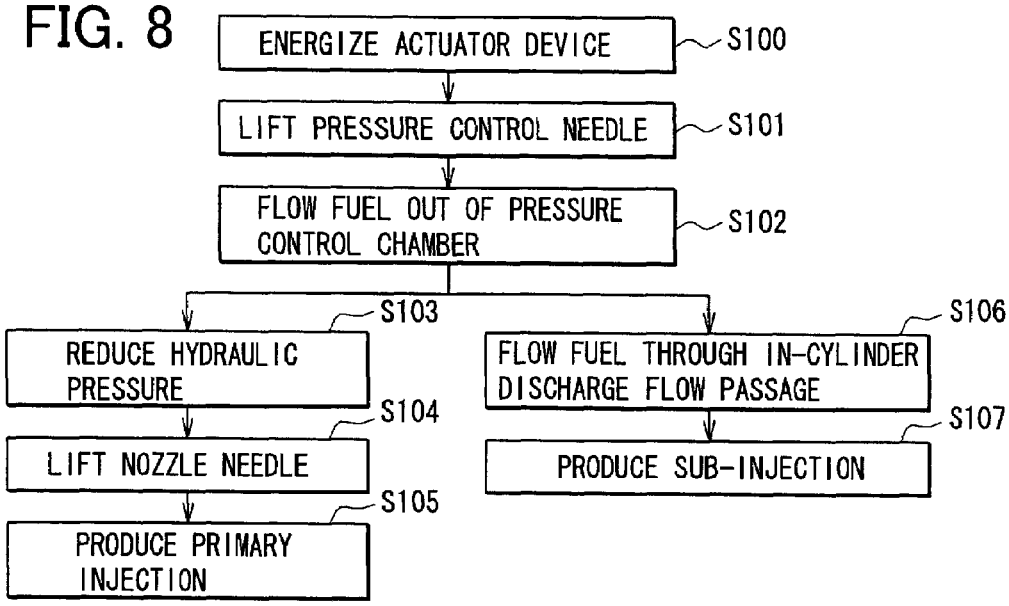
FIG. 8 is a flowchart illustrating a procedure of fuel injection.

The above feature can be applied to any kinds of fuel injection valves having an operation described in FIG. 8.

In step S100, the ECU 200 supplies electricity to the actuator device 60, 54, 50. In step S101, the stationary core 54 generates electromagnetic force by supplying electricity to the coil 60 of the actuator device 60, 54, 20, so that the movable core 51 is attracted by the electromagnetic force to lift the pressure control needle 53. In step S102, fuel flows out of the pressure control chamber 81 by lifting the pressure control needle 53. In step S103, the pressure control chamber 81 is reduced in hydraulic pressure. In step S104, the nozzle needle 30 is lifted in the valve opening direction A. In step S105, the primary injection is produced from the nozzle opening 31*o*. In addition, in step S106, fuel is introduced through the in-cylinder discharge flow passage 37. In step S107, the sub-injection is produced from the opening (sub-nozzle hole) 37*a*.

In addition, the ECU 200 operates the fuel injection valve 2 in the direct injection engine 100. The ECU 200 is provided with the EDU 202 to drive-the fuel injection valve 2, which jets high pressure fuel. According to this embodiment, drive force required for lifting the nozzle needle 30 is relatively small. Therefore, the electromagnetic actuators 60, 54, 50 of the fuel injection valve 2 need not a drive circuit such as a booster circuit for increasing drive force. Therefore, the EDU 200 may be simplified in construction.

Second Embodiment

Figure 9:
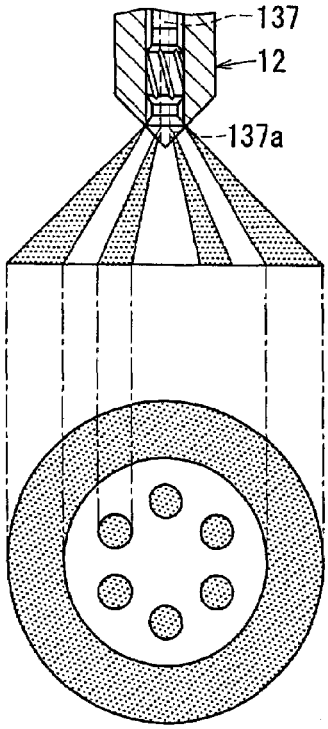
FIG. 9 is a view showing a valve body and a nozzle needle of a fuel injection valve according to a second embodiment.

According to this embodiment, as shown in FIG. 9, the opening of the in-cylinder discharge flow passage described in the first embodiment is constructed of multiple (six in this embodiment) of jet nozzles 137*a* instead of a single port.

In this structure, the opening 137*a* of the in-cylinder discharge flow passage 137 includes multiple jet nozzles. Multiple sub-injection can be arranged inside the primary spray in the form of a substantially hollow conical shape. Thus, atomization of the sub-injection jetted from the multiple jet nozzles 137*a* is promoted.

Third Embodiment

Figure 10:
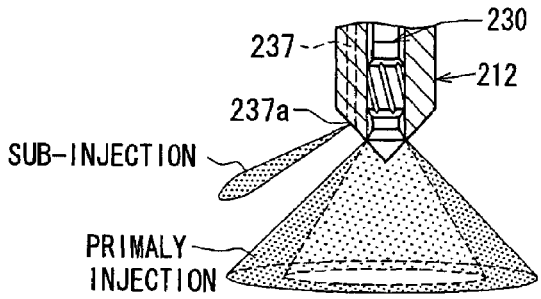
FIG. 10 is a longitudinal partially sectional view showing a valve body and a nozzle needle of a fuel injection valve according to a third embodiment.

According to the first embodiment, the in-cylinder discharge flow passage 37 and the opening 37*a* are provided inside the nozzle needle 30. By contrast, in this embodiment as shown in FIG. 10, at least a part of an in-cylinder discharge flow passage 237 and an opening 237*a* are formed inside a valve body 212. A nozzle needle 230 may not have an in-cylinder discharge flow passage.

In this construction, sub-injection jetted from the opening 237*a* of the in-cylinder discharge flow passage 237 can be arranged outside the primary spray in the form of a substantially hollow conical shape or the like.

Fourth Embodiment

According to the first embodiment, the fuel injection valve 2 has the outwardly opened valve structure. In contrast, as shown in FIG. 11, the third embodiment provides an inwardly opened valve structure, in which a valve body 312 accommodates therein a nozzle needle 330, which is axially movable thereby being seated on and lifted from a valve seat 313.

The nozzle needle 330 is axially movable similarly to the structure of the first embodiment. The valve opening is controlled by unseating the nozzle needle 330 axially inwardly from the valve seat 13.

Figure 11:
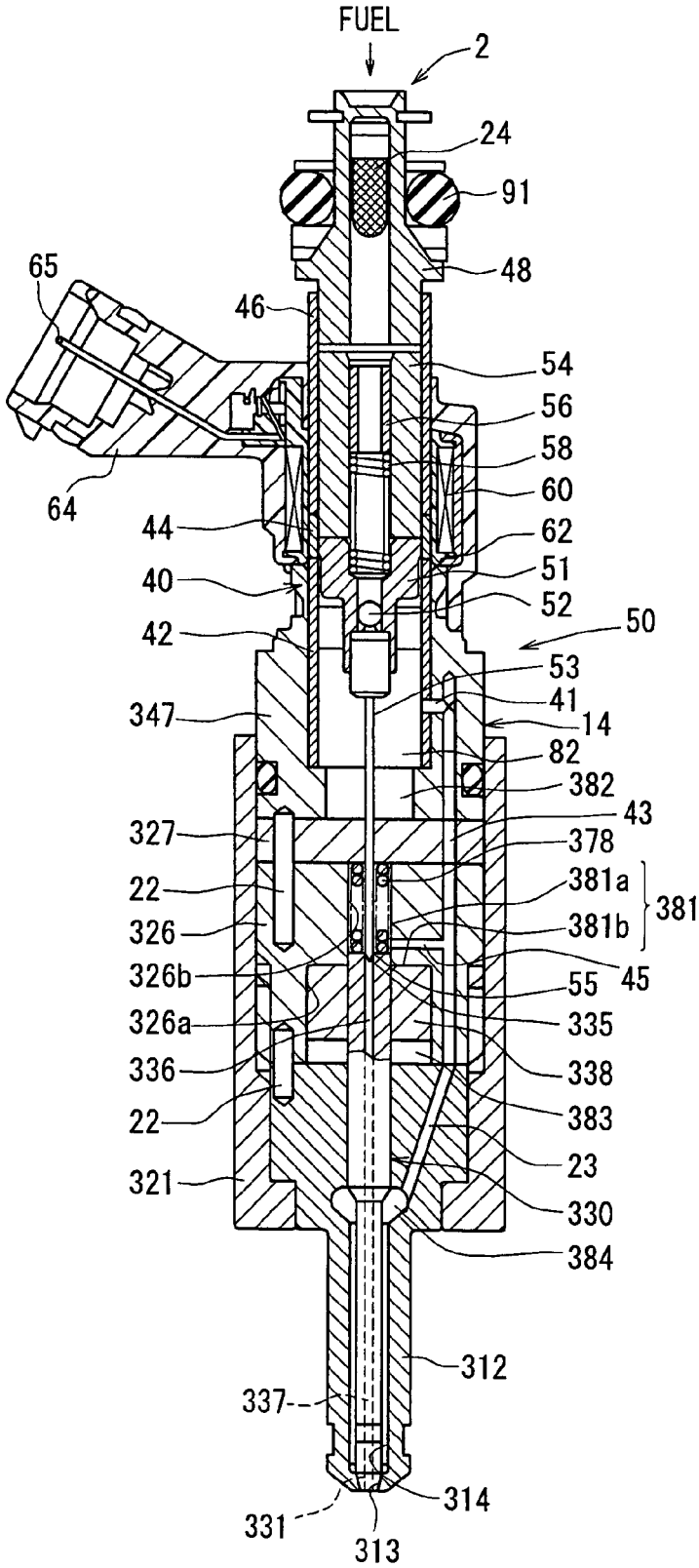
FIG. 11 is a longitudinal partially sectional view showing a fuel injection valve according to a fourth embodiment.

As shown in FIG. 11, the valve body 312 and the casing 14 are fixed together by a retaining nut 321 via a knock pin 22 and packings 326, 327 therebetween. The packings 326, 327 serve as intermediate members. A cylindrical member 40 of the casing 14 and the filter body 24 are fixed together by welding or the like. The packing 327 connects with a casing body 347.

The valve body 312, the packings 326, 327, the casing 14, and the filter body 24 are formed therein with fuel passages 41, 43, 23, and an inner fuel passage, through which fuel is supplied to the nozzle opening 31*o*. The orifice passage 45 communicates a pressure control chamber 381 with a fuel passage 43. In addition, a high-pressure fuel supplied from the fuel distribution pipe 8 (FIG. 1) flows into the fuel inlet 48 provided with the filter body 24.

As shown in FIG. 11, a hydraulically driven piston 338 is accommodated in a stepped inner periphery 326*a* of the packing 326.

A pressure control chamber 381 includes a first pressure control chamber 381*b* and a second pressure control chamber 381*a*. The first pressure control chamber 381*b* on the side of the valve seat 313 is defined by the end surface of the hydraulically driven piston 338. The first pressure control chamber 381*b* is also defined by the inner periphery 326*a*. The second pressure control chamber 381*a* accommodates a spring 378. The spring 378 is interposed between the upper end of the nozzle needle 330 and the packing 327. The orifice passage 45 communicates with the second pressure control chamber 381*a*.

A back-pressure chamber 383 is provided on the side of the valve seat 313 with respect to the hydraulically driven piston 38. The valve body 312 is formed with a fuel reservoir chamber 384, which communicates the fuel passage 23 with the fuel passage defined by the inner periphery 314.

The inner periphery 14 of the valve body 312 is reduced in diameter in the direction of fuel injection, so that the inner periphery 14 forms a conical surface 313. The conical surface 313 constructs a valve seat. An abutment 331 of the nozzle needle 330 is seated on and lifted from the conical surface 313. The conical surface 313 and the abutment 331 define a clearance as the nozzle opening 31*o* therebetween. Fuel is jetted from the clearance between the conical surface 313 and the abutment 331 along the conical surface 313, thereby jetting primary spray in the form of a substantially hollow conical shape.

A discharge flow passage 336 is formed axially in the nozzle needle 330 and an in-cylinder discharge flow passage 337. The discharge flow passage 336 opens at the tip end of the nozzle needle 330.

In this construction, it is possible to produce an effect similar to that in the first embodiment.

Other Embodiment

In the fourth embodiment, a jet nozzle plate having multiple minute jet nozzles may be provided at the tip end of a valve body 312. In this structure, fuel in primary spray and sub-spray is jetted through the multiple jet nozzles in the jet nozzle plate.

The above structures of the embodiments can be combined as appropriate.

Various modifications and alternations may be diversely made to the above embodiments without departing from the spirit of the present invention.

What is claimed is:

1. A fuel injection valve apparatus that is provided to a cylinder of an internal combustion engine for injecting fuel supplied from a fuel supply system into the cylinder, the fuel injection valve apparatus comprising:

an injection valve that includes:

a fuel inlet that connects with the fuel supply system;

an injector body that connects with the fuel inlet, the injector body having a pressure control chamber;

a valve body that connects with the injector body, the valve body facing an interior of the cylinder, the valve body having a valve seat;

a valve member that is surrounded by the valve body, the valve member being movable with respect to the valve seat of the valve body, the valve member having an internal passage that communicates with the interior of the cylinder; and an actuator, wherein the valve member is seated on the valve seat by being applied with hydraulic pressure from the pressure control chamber at least when the actuator blocks the pressure control chamber from the passage, and the valve member being lifted from the valve seat when the actuator communicates the pressure control chamber with the passage.

2. The fuel injection valve according to claim 1, wherein the valve member and the valve seat define a nozzle hole therebetween when the actuator communicates the pressure control chamber with the passage so that the valve member is lifted from the valve seat.

3. The fuel injection valve according to claim 1 wherein fuel is injected into the cylinder through the passage and the nozzle hole, when the actuator communicates the pressure control chamber with the passage thereby allowing the valve member to be lifted from the valve seat.

* * * * *